US010021953B2

(12) United States Patent
Kudo

(10) Patent No.: US 10,021,953 B2
(45) Date of Patent: Jul. 17, 2018

(54) LIQUID COSMETIC CONTAINER

(71) Applicant: TOKIWA CORPORATION, Nakatsugawa-shi, Gifu (JP)

(72) Inventor: Saori Kudo, Saitama (JP)

(73) Assignee: TOKIWA CORPORATION, Gifu (JP)

( * ) Notice: Subject to any disclaimer, the term of this patent is extended or adjusted under 35 U.S.C. 154(b) by 0 days.

(21) Appl. No.: 15/440,314

(22) Filed: Feb. 23, 2017

(65) Prior Publication Data

US 2017/0251787 A1 Sep. 7, 2017

(30) Foreign Application Priority Data

Mar. 1, 2016 (JP) ..... 2016-39020

(51) Int. Cl.
*B43K 8/00* (2006.01)
*A45D 34/04* (2006.01)

(52) U.S. Cl.
CPC .... *A45D 34/042* (2013.01); *A45D 2200/1072* (2013.01); *B43K 8/003* (2013.01)

(58) Field of Classification Search
CPC ..... B43K 8/003
USPC ..... 401/198, 199, 202, 205, 206, 207
See application file for complete search history.

(56) References Cited

U.S. PATENT DOCUMENTS 6,250,828 B1 * 6/2001 Liu ..... B43K 5/005 401/195
9,486,054 B2 11/2016 Tani

FOREIGN PATENT DOCUMENTS

JP 3-41609 4/1991

* cited by examiner

*Primary Examiner* — David Walczak
*Assistant Examiner* — Joshua Wiljanen
(74) *Attorney, Agent, or Firm* — Greenblum & Bernstein, P.L.C.

(57) ABSTRACT

A liquid cosmetic container includes a housing portion and a leading tube. The leading tube has an inclination portion at a tip end side. The inclination portion inclines with respect to an axis center of the container main body. A front end forms a side close to the axis center of the container main body in the opening of the inclination portion. A front end forms a side far from the axis center of the container main body in the opening. The front end is positioned on a front side with respect to the front end with a vertical cross section as a reference. The front end on a side to which the intermediate core warps extends forward in the inclination portion. This reduces the warp of the applying portion, further improving the usability.

3 Claims, 10 Drawing Sheets

LIQUID COSMETIC CONTAINER

TECHNICAL FIELD

The present invention relates to a liquid cosmetic container.

BACKGROUND ART

Conventionally, there has been known the following pencil-type application container. The application container houses an impregnated body into which cosmetic solution is impregnated in a long shaft tube. A rear end of an application bar made of a felt material or a similar material is inserted into the impregnated body. A tip of the shaft tube holds a tip end side part of the application bar, and the tip of this application bar is configured as an applying portion (for example, see Patent Literature 1). Using capillarity of the application bar, this application container absorbs up the cosmetic solution in the impregnated body and sends the cosmetic solution to the applying portion, thus ensuring an application of the cosmetic solution to an applied portion such as a skin.

CITATION LIST

Patent Literature

Patent Literature 1: Japanese Unexamined Utility Model Application Publication No. 3-41609

Technical Problem

To apply a makeup while a mirror is seen, the shaft tube of the pencil-type application container is hindrance. It is hard to see an application target and therefore the improvement has been requested.

An object of the present invention is to provide a liquid cosmetic container that does not hinder an application of a makeup while a mirror is seen and therefore an application target is seen easily, ensuring improving usability.

SUMMARY OF INVENTION

The liquid cosmetic container according to the present invention includes a container main body, a leading tube and an intermediate core. The container main body includes a housing portion to house a liquid cosmetic material therein. The leading tube is formed into a tubular shape, and is positioned on a tip end side of the container main body. The leading tube has a tube hole communicating with the housing portion. The intermediate core is disposed in the container main body and the leading tube, and sends the liquid cosmetic material. A rear end of the intermediate core is positioned inside the housing portion, and a tip of the intermediate core projects from an opening at a tip of the leading tube to form an applying portion. The leading tube has an inclination portion at a tip end side, and the inclination portion inclines with respect to an axis center of the container main body. The intermediate core inclines following a tube hole on the inclination portion. One front end part forms a side part close to the axis center of the container main body in the opening of the inclination portion, and another front end part forms a side part far from the axis center of the container main body in the opening. The one front end part is positioned on a front side with respect to the other front end part with a vertical cross section as a reference, and the vertical cross section is vertical to an axis center of the inclination portion.

With this liquid cosmetic container, the leading tube on the tip end side of the container main body includes the inclination portion inclining to the axis center of the container main body. The container does not hinder an application of a makeup while a mirror is seen and therefore an application target is seen easily, ensuring improving usability.

Here, the inventor has found the following. When the inclined intermediate core is impregnated with the liquid cosmetic material, the intermediate core has a property of warping back so as to recover a state before the inclination. While the intermediate core inclines following the tube hole inside the inclination portion, the intermediate core warps so as to recover the state before the inclination in the applying portion, which projects from an opening on the tip of the leading tube. With thus warped applying portion, the axis center of the applying portion is displaced (becomes eccentric) from the axis center of the inclination portion. This makes the application difficult (makes a drawing difficult).

The liquid cosmetic container according to the present invention employs the following configuration. In the inclination portion, the one front end part, which forms the side close to the axis center of the container main body in the opening, is positioned on the front side with respect to the other front end part, which forms the side far from the axis center of the container main body in the opening, with the vertical cross section as the reference. The vertical cross section is vertical to the axis center of the inclination portion. In the inclination portion, the one front end part on the side to which the intermediate core attempts to warp extends forward. This one front end part extending forward can reduce the warp of the applying portion. Accordingly, the user can provide the application while seeing the mirror with the applying portion not warped. This ensures further improving the usability.

Here, a specific configuration that provides the actions and effects includes a configuration that the top end surface of the leading tube has the inclined surface inclined forward with respect to the vertical cross section vertical to the axis center of the inclination portion.

The specific configuration that provides the actions and effects includes a configuration that includes the projecting portion projecting forward on the side close to the axis center of the container main body in the inclination portion.

Advantageous Effects of Invention

Thus, the present invention can provide a liquid cosmetic container that does not hinder an application of a makeup while a mirror is seen and therefore an application target is seen easily, ensuring improving usability.

DESCRIPTION OF EMBODIMENTS

Figure 6:
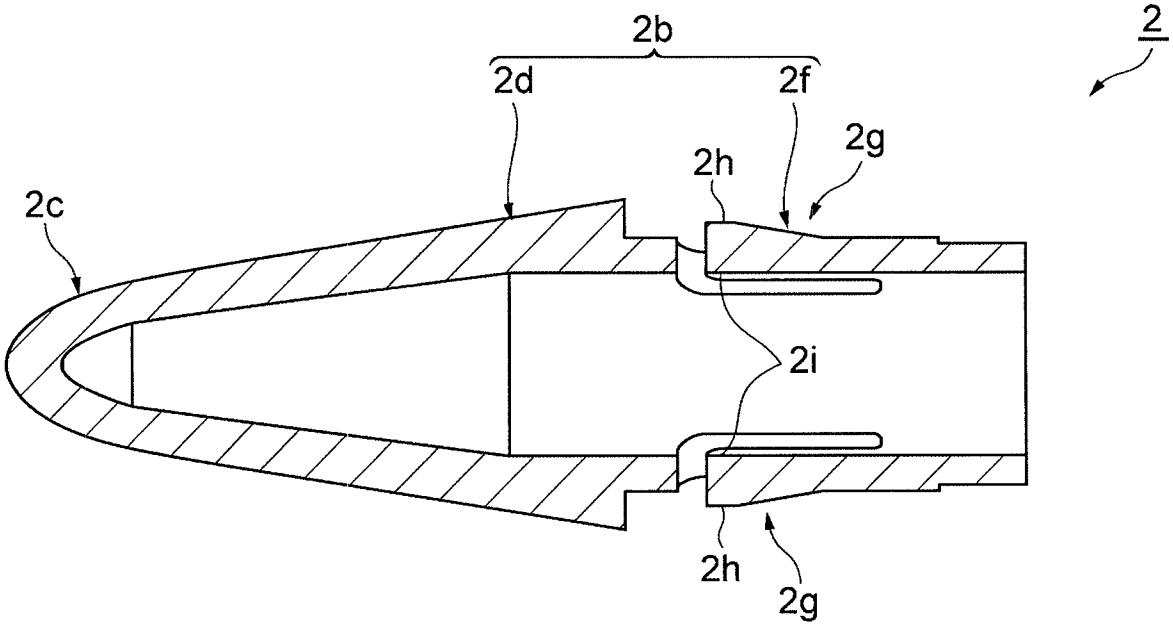
FIG. 6 is an arrow view taken along VI-VI in FIG. 3.
Figure 7:
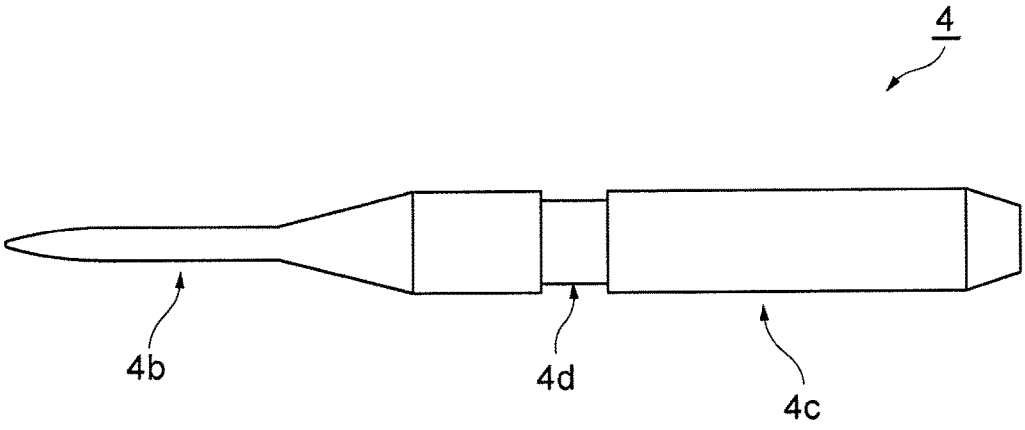
FIG. 7 is a front view illustrating an intermediate core in FIG. 1 before incorporation.
Figure 8:
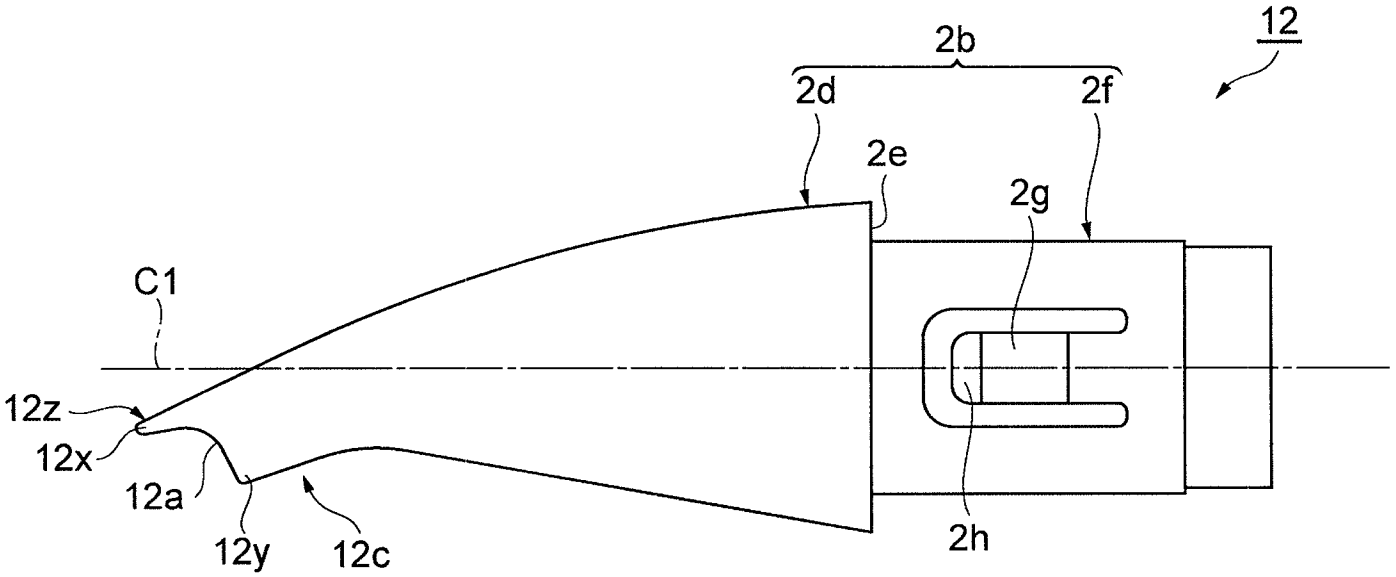
FIG. 8 is a front view illustrating a leading tube of a liquid cosmetic container according to a second embodiment of the present invention.
Figure 9:
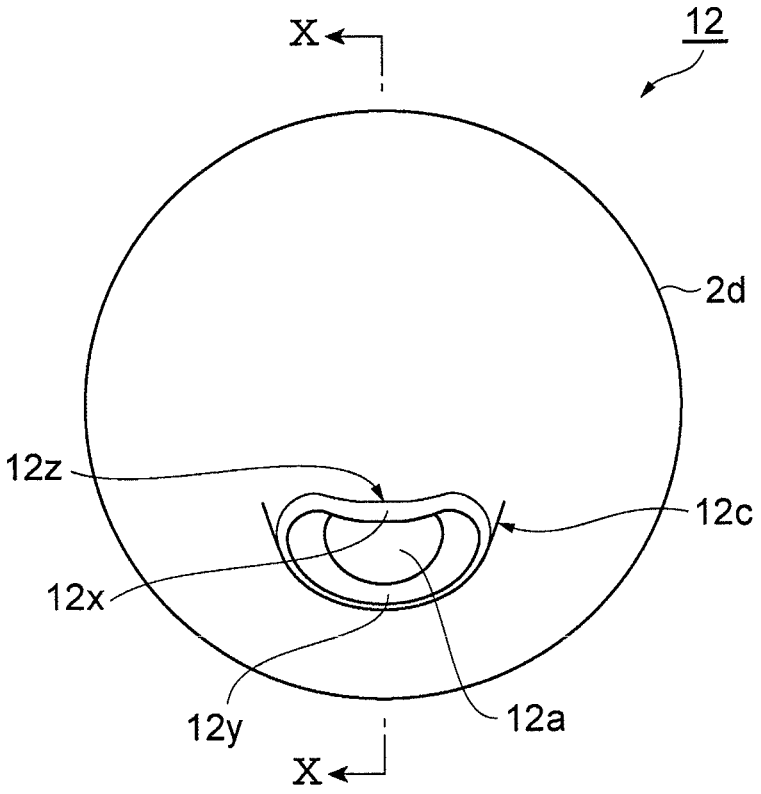
FIG. 9 is a left side view of the leading tube illustrated in FIG. 8.
Figure 10:
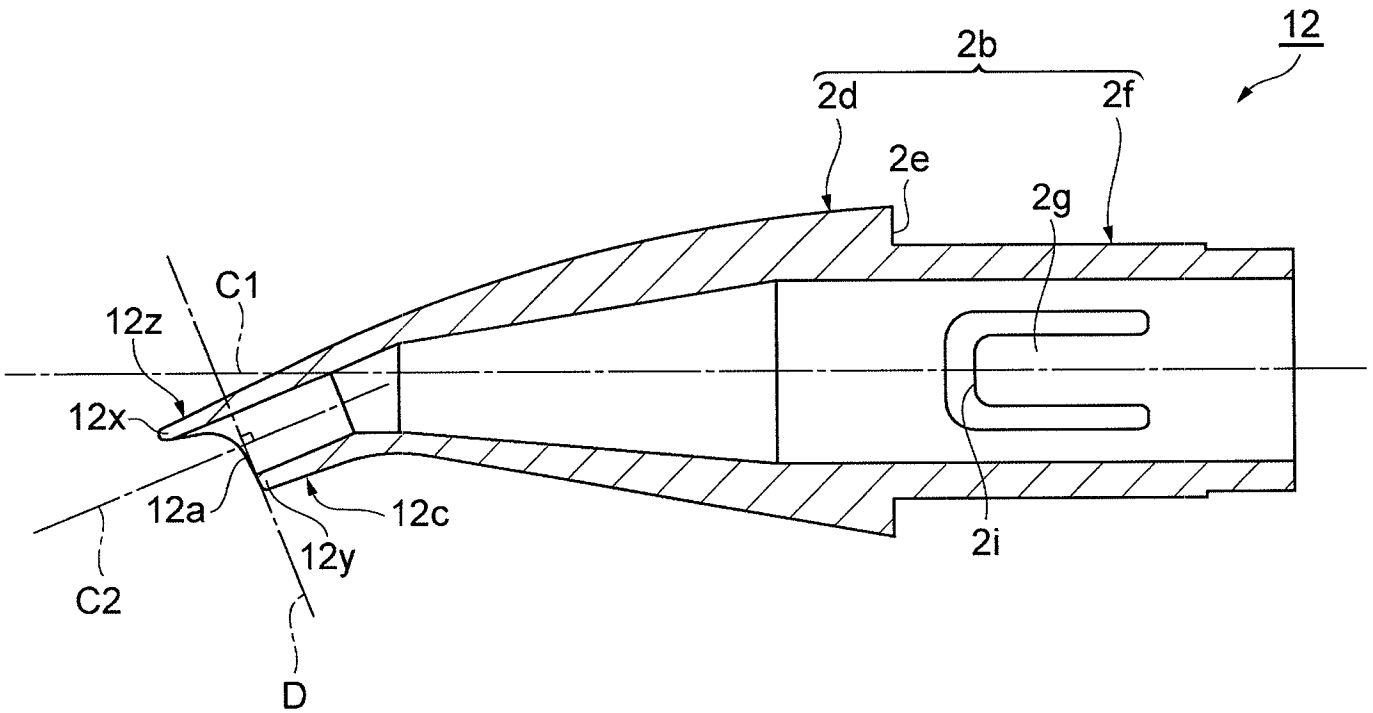
FIG. 10 is an arrow view taken along X-X in FIG. 9.

The following describes preferred embodiments of a liquid cosmetic container according to the present invention with reference to FIG. 1 to FIG. 10. FIG. 1 to FIG. 7 illustrate a first embodiment of the present invention. FIG. 8 to FIG. 10 illustrate a second embodiment of the present invention. The same reference numerals are attached to the same elements in the respective drawings, and an overlapping description will be omitted.

First, the following describes the first embodiment illustrated in FIG. 1 to FIG. 7.

Figure 1:
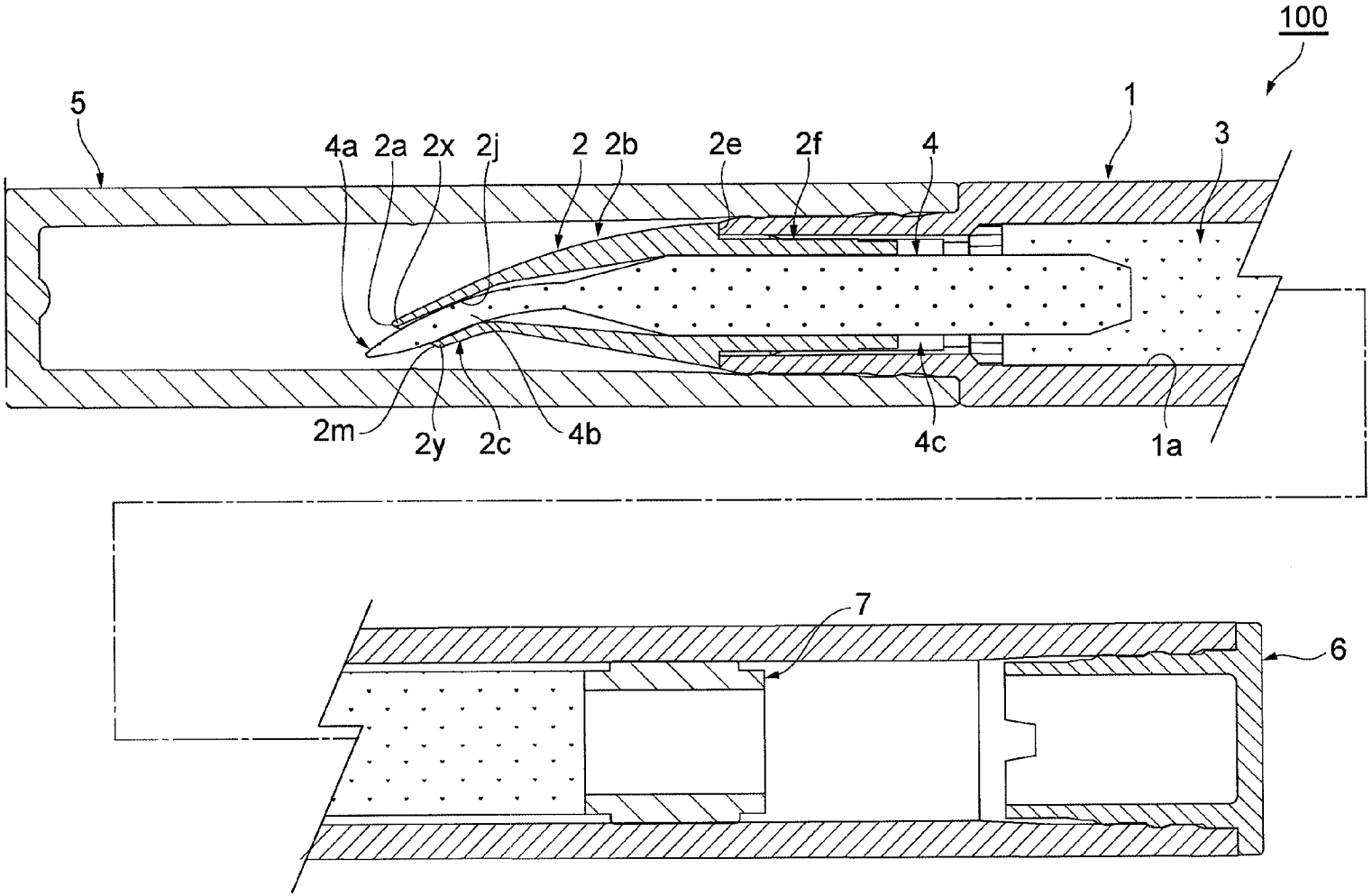
FIG. 1 is a vertical cross-sectional view illustrating a liquid cosmetic container according to a first embodiment of the present invention.
Figure 2:
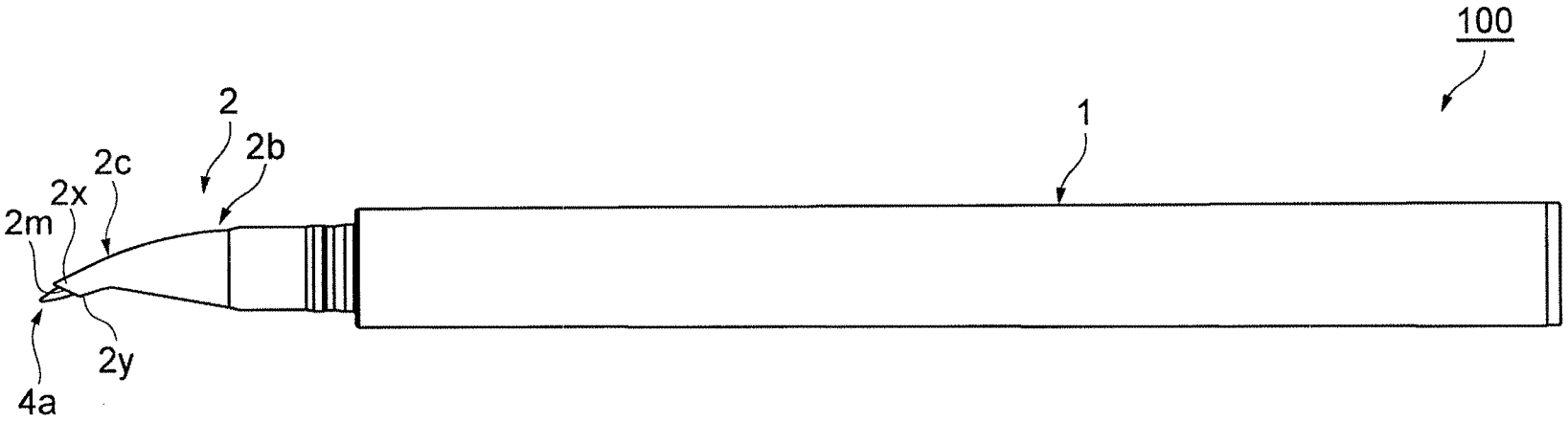
FIG. 2 is a front view illustrating a state of removing a cap from the liquid cosmetic container illustrated in FIG. 1.
Figure 5:
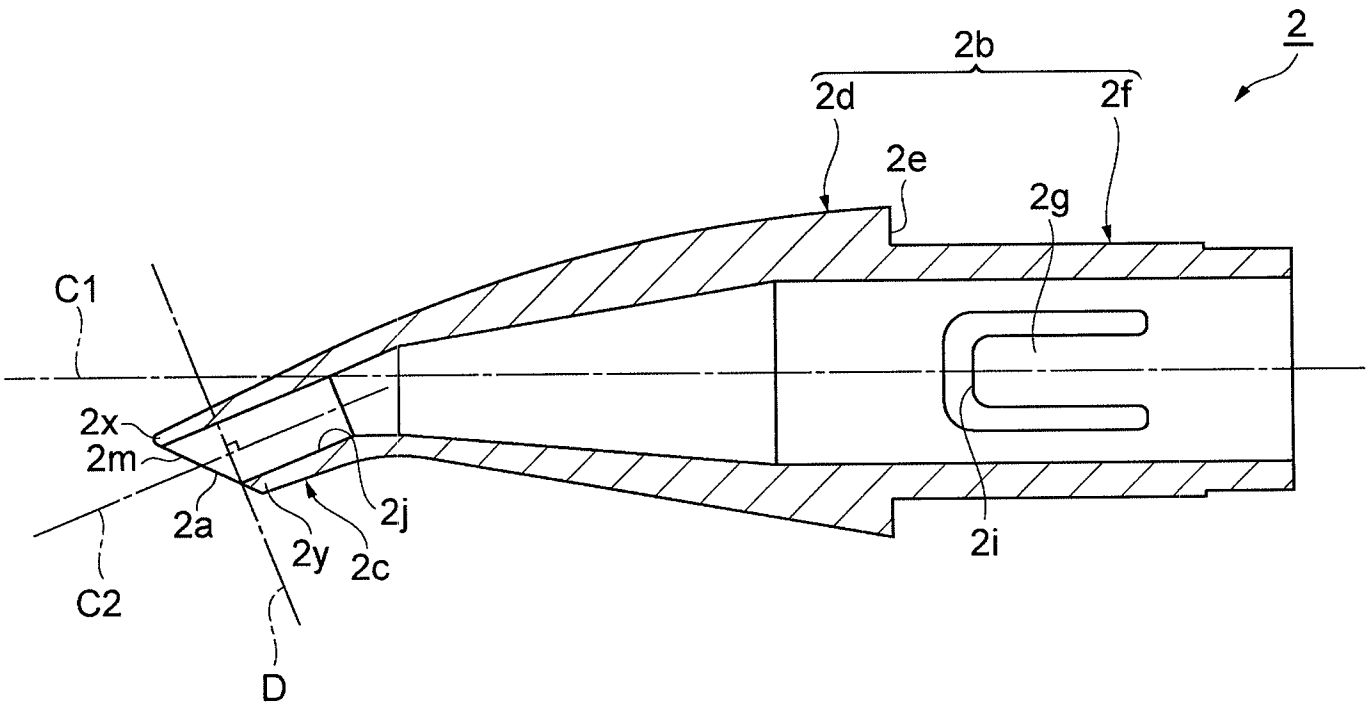
FIG. 5 is an arrow view taken along V-V in FIG. 4.

FIG. 1 is a vertical cross-sectional view illustrating the liquid cosmetic container according to the first embodiment of the present invention. FIG. 2 is a front view illustrating the liquid cosmetic container in FIG. 1 from which a cap is removed. FIG. 3 to FIG. 6 are drawings each illustrating a leading tube. FIG. 7 is a front view illustrating an intermediate core before incorporation. The liquid cosmetic container of this embodiment is used for an application of a liquid cosmetic material to an applied portion.

As illustrated in FIG. 1 and FIG. 2, a liquid cosmetic container 100 includes a container main body 1 and a leading tube 2, which constitute an outer shape of the container, and as illustrated in FIG. 1, includes an inner cotton 3 housed in the container main body 1, an intermediate core 4, and a cap 5. The intermediate core 4 is housed in the container main body 1 and the leading tube 2 and projects from an opening 2*a*, which is at a tip of the leading tube 2. The cap 5 is removably installed to a tip end side of the container main body 1 to protect an applying portion 4*a* (the details will be described later), which is a tip end part of the intermediate core 4.

The container main body 1 is made of, for example, a PP and is formed into a tapered, stepped cylindrical shape. Installation of a tail plug 6 to the container main body 1 closes an opening at a rear end of the container main body 1. An internal space formed rearward with respect to a stepped portion on an outer peripheral surface of the container main body 1 is configured as a housing portion 1*a* to house the liquid cosmetic material. The housing portion 1*a* is filled with the inner cotton 3 into which the liquid cosmetic material is impregnated. The inner cotton 3 is, for example, made of a polyester. An adjuster 7, which is disposed at a rear end of the inner cotton 3, can adjust a size of the inner cotton 3.

Here, an eyeliner cosmetic material is used as the liquid cosmetic material impregnated into the inner cotton 3, and an eyeliner cosmetic container is used as the liquid cosmetic container as specifically preferable. However, another liquid cosmetic material such as liquid cosmetic material for eyebrow or hair mascara is applicable as the liquid cosmetic material.

Figure 3:
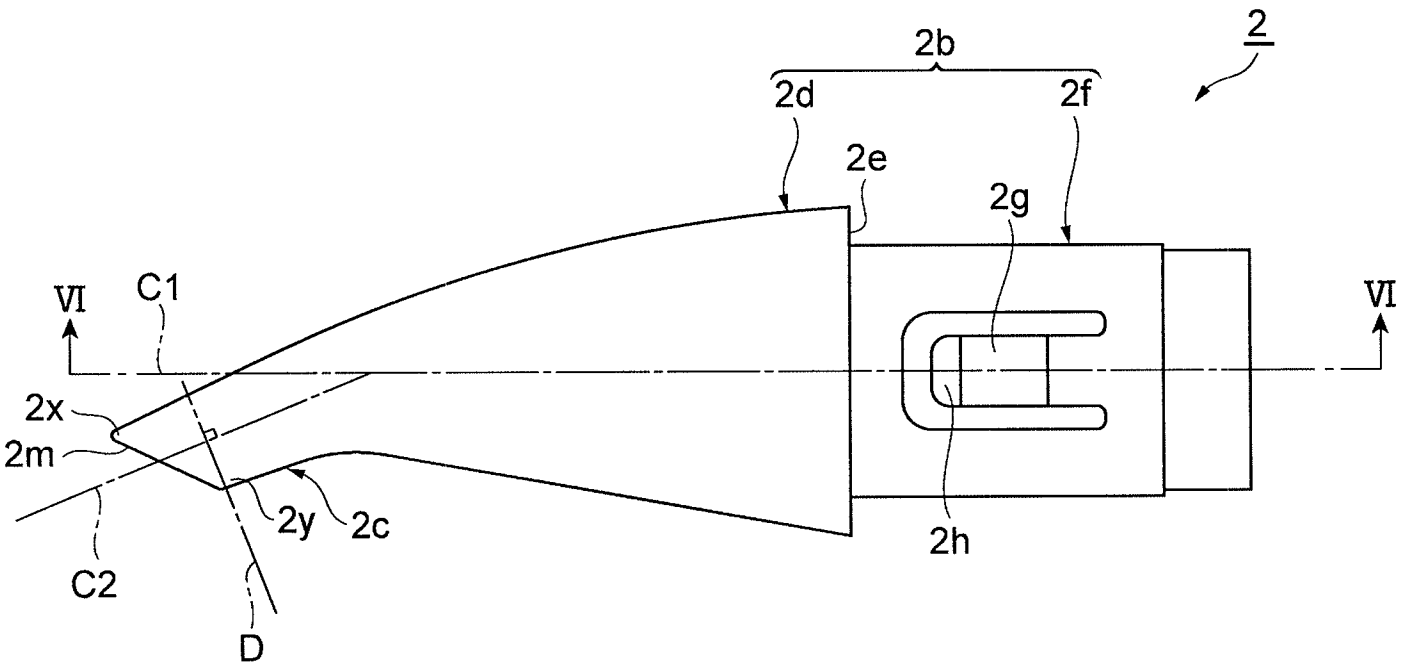
FIG. 3 is a front view illustrating a leading tube in FIG. 1 and FIG. 2.

The leading tube 2 serves as a holder to hold the intermediate core 4. The leading tube 2 is made of the PP or a similar material and is formed into a tubular shape. As illustrated in FIG. 3 and FIG. 5, the leading tube 2 includes a base portion 2*b* and an inclination portion 2*c*. The base portion 2*b* is positioned concentrically with an axis center C1 of the container main body 1 and almost linearly extends. The inclination portion 2*c* inclines so as to curve (so as to bend) from a tip of the base portion 2*b*.

The base portion 2*b* includes a tapered cylindrical portion 2*d* and a small-diameter cylindrical portion 2*f* with small diameter. A cylinder of the tapered cylindrical portion 2*d* is tapered along the axis center C1. The small-diameter cylindrical portion 2*f* is installed consecutively from a rear end of the tapered cylindrical portion 2*d* via a stepped surface 2*e*.

The small-diameter cylindrical portion 2*f* is a part inserted into a tip end of the container main body 1. As illustrated in FIG. 3, FIG. 5, and FIG. 6, springs 2*g* and 2*g* are disposed at opposed positions on the outer peripheral surface of the small-diameter cylindrical portion 2*f*. The springs 2*g* and 2*g* are notched to have a U shape to communicate with the inside and the outside of the tube, and rear portions of the springs 2*g* and 2*g* are cantilevered. A convex portion 2*h*, which is disposed on a tip end side and an outer peripheral side of this spring 2*g*, is a part abutting on an inner peripheral surface of the tip end of the container main body 1. An end on a tip end side and an inner peripheral side of the spring 2*g* is configured as an engaging end 2*i* to engage the intermediate core 4.

Figure 4:
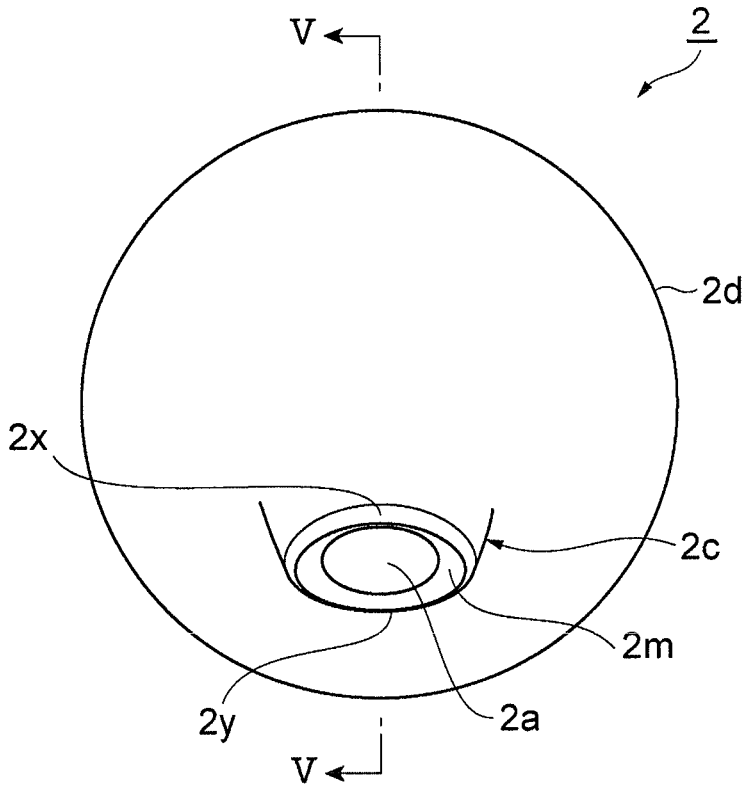
FIG. 4 is a left side view of the leading tube illustrated in FIG. 3.

As illustrated in FIG. 3 to FIG. 5, the inclination portion 2*c* with a cylindrical shape inclines and is continuous to the tip of the tapered cylindrical portion 2*d*. An axis center C2 of the inclination portion 2*c* inclines with respect to the axis center C1 of the container main body 1.

As illustrated in FIG. 3 and FIG. 5, this inclination portion 2*c* includes a front end part 2*x* and a front end part 2*y*. The front end part 2*x* forms a side close to the axis center C1 of the container main body 1 in the opening 2*a* at the tip of the inclination portion 2*c*. The front end part 2*y* forms a side far from the axis center C1 of the container main body 1 in the opening 2*a*. The front end part 2*x* is positioned on the front side with respect to the front end part 2*y* with a vertical cross section D, which is vertical to the axis center C2 of the inclination portion 2*c*, as a reference.

Specifically, a top end surface of the leading tube 2 is formed as an inclined surface 2*m* inclined forward with respect to the vertical cross section D, which is vertical to the axis center C2 of the inclination portion 2*c*.

As illustrated in FIG. 1, the intermediate core 4 is shaft shaped and disposed inside the container main body 1 and the leading tube 2. This intermediate core 4 can develop capillarity. As the intermediate core 4, various intermediate cores such as one formed by polishing process on a synthetic fiber such as an acrylic, a polyester, and a nylon adhered with a resin, one formed by punching process on a sheet-shaped synthetic fiber, and one formed by molding a porous polyurethane with mold are applicable.

As illustrated in FIG. 7, before being incorporated into the leading tube 2, the intermediate core 4 linearly extends along the axis center. A tip end side of the intermediate core 4 extends along the axis center direction as a small-diameter portion 4*b*. A part rearward with respect to this small-diameter portion 4*b* is configured as a large-diameter portion 4*c* with large diameter. A pair of grooves 4*d* opposed to each other are formed in the middle of the large-diameter portion 4*c* in the axis center direction. The engaging ends 2*i* of the leading tube 2 enter the pair of grooves 4*d*.

The intermediate core 4, which is formed of the material as described above and linearly extends, has a property where a bent part of the intermediate core 4 warps so as to recover the original shape through the impregnation of the liquid cosmetic material into the bent intermediate core 4.

As illustrated in FIG. 1, the tip end side of the intermediate core 4 is inserted inside a tube hole on the base portion 2*b* of the leading tube 2. The small-diameter portion 4*b* on the tip end side of the intermediate core 4 is bent (curves) and inclines so as to follow the tube hole 2*j* on the inclination portion 2*c*. The tip end part of the intermediate core 4 projects from the opening 2*a* on the leading tube 2, and this projected part is configured as the applying portion 4*a*. This applying portion 4*a* achieves a function similar to one referred to as a so-called chip.

The small-diameter cylindrical portion 2*f* of the base portion 2*b* is inserted inside the tube hole on the tip end of the container main body 1, the convex portions 2*h* (see FIG. 6) of the springs 2*g* of the leading tube 2 abut on and are brought into pressure contact with the inner peripheral surface of the container main body 1 with the stepped surfaces 2*e* abutting on the top end surface of the container main body 1. Thus, the leading tube 2 with the intermediate core 4 is installed to the container main body 1. Further, this pressure contact pushes the springs 2*g* to the inside. The engaging ends 2*i* (see FIG. 6) of the springs 2*g* enter the grooves 4*d* (see FIG. 7) on the intermediate core 4, thus installing the intermediate core 4 to the leading tube 2. With this state, the tube hole on the leading tube 2 communicates with the housing portion 1*a* of the container main body 1, and the rear end portion of the intermediate core 4 is positioned inside the housing portion 1*a* and is inserted into the inner cotton 3.

That is, the liquid cosmetic container 100 illustrated in FIG. 1 and FIG. 2 is obtained.

According to this embodiment, the leading tube 2 on the tip end side of the container main body 1 includes the inclination portion 2*c* inclining to the axis center C1 of the container main body 1. The container does not hinder the application of a makeup while a mirror is seen and therefore an application target is seen easily, ensuring improving usability.

With the liquid cosmetic container 100 illustrated in FIG. 1 and FIG. 2, the intermediate core 4 absorbs up the liquid cosmetic material impregnated into the inner cotton 3 by the capillarity of the intermediate core 4 and sends the liquid cosmetic material to the applying portion 4*a* at the tip, thus impregnating the liquid cosmetic material.

Then, the bent small-diameter portion 4*b* of the intermediate core 4 attempts to recover the original state before the inclination.

However, in this embodiment, as described above and as illustrated in FIG. 1 and FIG. 5, in the inclination portion 2*c*, the front end part 2*x*, which forms the side close to the axis center C1 of the container main body 1 in the opening 2*a* at the tip of the inclination portion 2*c*, is positioned on the front side with respect to the front end part 2*y*, which forms the side far from the axis center C1 of the container main body 1 in the opening 2*a*, with the vertical cross section D as the reference. The vertical cross section D is vertical to the axis center C2 of the inclination portion 2*c*. The top end surface of the leading tube 2 is formed as the inclined surface 2*m* inclined forward with respect to the vertical cross section D, which is vertical to the axis center C2 of the inclination portion 2*c*. In the inclination portion 2*c*, the front end part 2*x* on the side to which the intermediate core 4 attempts to warp extends forward. This front end part 2*x* extending forward can reduce the warp of the applying portion 4*a*. Accordingly, the user can provide the application while seeing the mirror with the applying portion 4*a* not warped. This further ensures improving the usability.

FIG. 8 is a front view illustrating a leading tube of a liquid cosmetic container according to a second embodiment of the present invention. FIG. 9 is a left side view of FIG. 8. FIG. 10 is an arrow view taken along X-X in FIG. 9.

The liquid cosmetic container of this second embodiment differs from the liquid cosmetic container of the first embodiment in that the liquid cosmetic container of the second embodiment includes a leading tube 12 that includes an inclination portion 12*c* as illustrated in FIG. 8 to FIG. 10 instead of the leading tube 2 with the inclination portion 2*c*.

Similar to the first embodiment, in this inclination portion 12*c* of the leading tube 12, the front end part 12*x*, which forms a side close to the axis center C1 of the container main body 1 in an opening 12*a* at a tip of the inclination portion 12*c*, is positioned on a front side with respect to a front end part 12*y*, which forms a side far from the axis center C1 of the container main body 1 in the opening 12*a* with the vertical cross section D, which is vertical to the axis center C2 of the inclination portion 12*c*, as the reference as well. However, the inclination portion 12*c* differs in the specific configuration.

That is, in the second embodiment, the inclination portion 12*c* includes a projecting portion 12*z* projecting forward on the side close to the axis center C1 of the container main body 1. More specifically, in the inclination portion 12*c*, a front end part 12*x*, which is on the side to which the intermediate core 4 attempts to warp, extends forward and forms the projecting portion 12*z*, thus being configured to have a canopy shape. This projecting portion 12*z* can reduce the warp of the applying portion 4*a*. Therefore, it is obvious that the actions and effects similar to those of the first embodiment are provided.

While the present invention has been specifically described on the basis of its embodiment, the present invention is not limited to the above embodiment. For example, the embodiment describes the application of the liquid cosmetic container of inner cotton type that houses the inner cotton 3 containing the liquid cosmetic material in the housing portion 1*a* of the container main body 1 and sends the liquid cosmetic material from the inner cotton 3 to the applying portion 4*a* at the tip of this intermediate core 4 through the intermediate core 4. However, the present invention is also applicable to a liquid cosmetic container where the liquid cosmetic material is directly filled to the inside of the housing portion 1*a* and this liquid cosmetic material is supplied to the applying portion 4*a* through the intermediate core 4.

While the embodiment has the configuration in which the leading tube 2 (12) includes the base portion 2*b* and the inclination portion 2*c* (12*c*), the entire leading tube may be the inclination portion. The leading tube 2 (12) and the container main body 1 may be an integrated product.

The intermediate core 4 including the applying portion 4*a* may be replaced by a configuration such as a writing brush and a brush.

A liquid cosmetic container that pushes out the liquid cosmetic material by a push-out mechanism and a squeeze type liquid cosmetic container such as a tube and a soft bottle that can push out the liquid cosmetic material by a pressing force by the user may be applicable as the liquid cosmetic container.

What is claimed is:

1. A liquid cosmetic container comprising:

a container main body that includes a housing to house a liquid cosmetic material therein;

a leading tube formed into a tubular shape, the leading tube being positioned on a tip end side of the container main body, the leading tube having a tube hole communicating with the housing; and an intermediate core disposed in the container main body and the leading tube, the intermediate core sending the liquid cosmetic material, wherein:

a rear end of the intermediate core is positioned inside the housing, a tip of the intermediate core projecting from an opening at a tip of the leading tube to form an applicator, the leading tube has an inclination portion at a tip end side, the inclination portion inclining with respect to an axis center of the container main body, the intermediate core inclines following a tube hole on the inclination portion, and one front end part forms a side part closer to the axis center of the container main body in the opening of the inclination portion than another front end part forming a side part farther than the one front end part from the axis center of the container main body in the opening, the one front end part protruding more distally than the other front end part, with a vertical cross section as a reference, the vertical cross section being vertical to an axis center of the inclination portion.

2. The liquid cosmetic container according to claim 1, wherein a top end surface of the leading tube is formed as an inclined surface, the inclined surface being inclined forward with respect to the vertical cross section, the vertical cross section being vertical to the axis center of the inclination portion.

3. The liquid cosmetic container according to claim 1, wherein the inclination portion includes a projecting portion, the projecting portion projecting forward on a side close to the axis center of the container main body.

* * * * *